US006129232A

United States Patent [19]

Williams

[11] Patent Number: 6,129,232

[45] Date of Patent: Oct. 10, 2000

[54] FOOD AND BEVERAGE TRAY

[76] Inventor: Ann M. Williams, 14022 Waterville Way, Houston, Tex. 77015

[21] Appl. No.: 09/435,936

[22] Filed: Nov. 9, 1999

[51] Int. Cl.[7] ..... B65D 25/00

[52] U.S. Cl. ..... 220/521; 220/556; 220/23.83; 229/406; 229/904

[58] Field of Search ..... 220/521, 556, 220/23.8, 23.83, 23.86; 229/406, 904

[56] References Cited

U.S. PATENT DOCUMENTS

| | | | |
|---|---|---|---|
| 2,924,372 | 2/1960 | Kirkeby | 229/34 |
| 3,899,119 | 8/1975 | Roccaforte | 229/29 |
| 3,944,109 | 3/1976 | Holz | 229/406 X |
| 4,013,798 | 3/1977 | Goltsos | 220/556 X |
| 4,595,102 | 6/1986 | Cianci et al. | 220/521 X |
| 5,205,474 | 4/1993 | Stuart et al. | 229/1.5 H |
| 5,533,639 | 7/1996 | Myers | 220/556 X |
| 5,732,847 | 3/1998 | Caldi | 220/23.83 X |
| 5,788,081 | 8/1998 | Bates | 206/562 |
| 5,857,583 | 1/1999 | Chantaca et al. | 220/556 X |

*Primary Examiner*—Steven Pollard
*Attorney, Agent, or Firm*—Robert W.. Strozier

[57] ABSTRACT

A container designed for the easy transportation of a beverage and a meal or snack when closed, and for the convenient upright retention of the beverage when open. The container includes a beverage retention well positioned in the container's interior and a corresponding beverage holder, positioned above the retention well, in the container's lid.

7 Claims, 4 Drawing Sheets

FOOD AND BEVERAGE TRAY

BACKGROUND OF THE INVENTION

1. Field of the Invention

In one aspect, the present invention relates to containers, and to methods of using containers. In another aspect, the present invention relates to containers for transporting food and beverages. In even another aspect, the present invention relates to containers for transporting food and beverages which include a beverage retention well. In still another aspect, the present invention relates to containers for transporting food and beverages that include beverage retention wellS which may be utilized when the container is in an open or a closed position.

2. Description of the Related Art

There have been several attempts in the prior art to provide for functional containers and trays for carrying food and beverages.

U.S. Pat. No. 5,788,081 issued Aug. 4, 1998, to Bates, discloses a multiple product container having at least one tubular compartment disposed adjacent a tray compartment. The tubular compartment having at least one aperture at its top most portion for extraction of an elongated product and retention of the elongated product in an upright disposition. A tear strip further facilitates removal of the elongated product from the tubular compartment.

U.S. Pat. No. 5,205,747 issued Apr. 27, 1993, to Stuart et al. discloses a blank and carry-out tray for carrying a variety of food products. The tray is capable of transformation from a storage condition of a substantially flat configuration to an erect and upright useable condition by manipulation of a plurality of foldably connected portions that move similarly to a parallel linkage arrangement and which are provided with a locking mechanism that automatically lock the tray in its upright and useable condition.

U.S. Pat. No. 3,899,119 issued Aug. 12, 1975, to Roccaforte discloses a carton with a lid hingedly attached and integrally formed apertured platform foldable inside of the carton tray and spaced parallel to and above the bottom of the tray with a hinged lid having side flaps foldable down over the tray to make a complete enclosed carton.

U.S. Pat. No. 2,249,327 issued Feb. 9, 1960, to Kirkeby discloses a lap tray including a spaces and holders for various food containers, utensils and condiments formed with a cover, and an adjacent container area for holding containers of various heights.

In spite of these advances, there is a need for improved food and beverage containers, which do not suffer from the deficiencies of the prior art.

There is another need in the art for food and beverage containers which allow for the convenient transportation of a beverage and food, and to methods of using same.

There is even another need in the art for food and beverage containers which allow for the upright retention of a beverage when the container is in the open and closed position.

These and other needs in the art will become apparent to those of skill in the art upon review of this specification and drawings.

SUMMARY OF THE INVENTION

It is an object of the present invention to provide for food and beverage containers, and methods of using such containers, which do not suffer from the disadvantages of the prior art.

It is another object of the present invention to provide for food and beverage containers which allow for the convenient transportation of a beverage and food, and to provide methods of using same.

It is even another object of the present invention to provide for food and beverage containers which allow for the upright retention of a beverage when the container is in the open and closed position.

These and other objects of the present invention will become apparent to those of skill in the art upon review of this specification and drawings.

According to one embodiment of the present invention, there is provided a container including an interior compartment, having a beverage retention well defining a first opening for holding a beverage container, and a container lid, having a beverage holder defining a second opening for holding the beverage container, wherein the beverage holder is positioned in the first opening when the container lid is in a closed position.

The present invention also provides a method of using the container. The method includes positioning a food into the container interior wherein the interior includes a beverage retention well defining an opening for holding a beverage container, closing the container lid wherein the lid includes a beverage holder defining a second opening for holding the beverage container, wherein the beverage holder is positioned in the first opening when the container lid is in a closed position, and placing a beverage container in the first opening when the container lid is in the closed position.

BRIEF DESCRIPTION OF THE DRAWINGS

The invention can be better understood with reference to the following detailed description together with the appended illustrative drawings in which like elements are numbered the same.

DETAILED DESCRIPTION OF THE INVENTION

The container of the present invention is designed for the easy transportation of a beverage with a meal, snack dessert, or the like, when the container is closed. The carry out container of the present invention is also designed to provide convenient upright retention of a beverage when the container is opened.

Referring now to the figures, the food and beverage containers of the present invention will be shown and described in detail.

Figure 1:
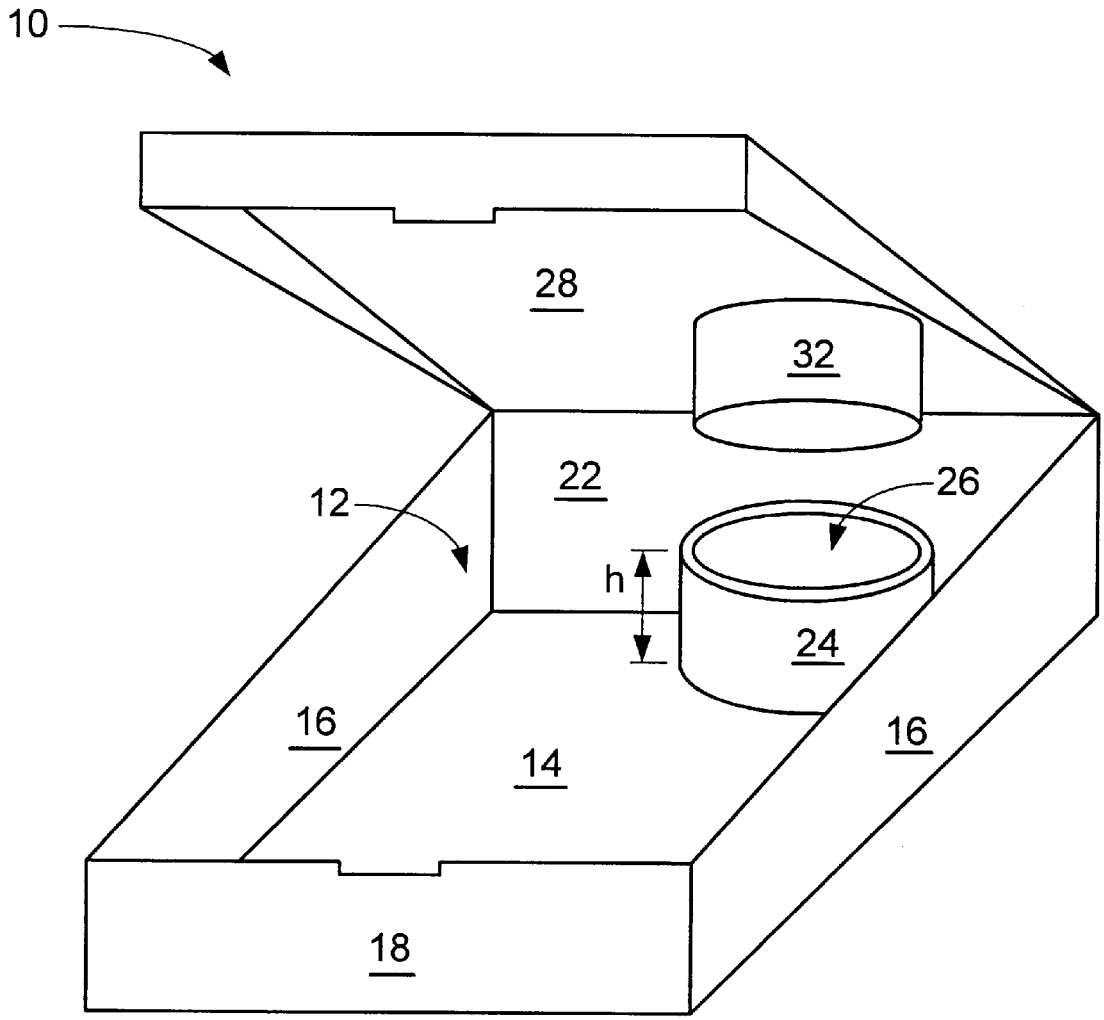
FIG. 1 is a perspective view of one embodiment of tray 10 of the present invention.

Referring to FIG. 1 there is shown a perspective view of one embodiment of the tray or container, shown generally as 10, of the present invention. Container 10 generally includes food compartment 12, bottom panel 14, side panels 16, front panel 18 and rear panel 22. Beverage retainer well 24 is positioned in compartment 12 and defines opening 26. Container 10 also includes lid 28, associated with food compartment 12, and having beverage holder 32, which is preferably closed at its bottom to prevent spilled fluid from entering the container 10.

Container 10 may be manufactured from any suitable material as is known in the art. Non-limiting examples of suitable materials include paper stock, corrugated paper, plastic, styrofoam or a combination thereof. Container 10 may be of any suitable size and shape to provide food compartment 12 appropriately sized to accommodate a particular meal or snack and a beverage or beverages. For example compartment 12 may be sized to accommodate single meal, a sandwich, a dessert, or a pizza. Compartment 12 may be a single compartment or partitioned to form individuals compartments for different foods. While shown in the FIGs. to be generally square in shape, it is understood that container 10 may be any desired shape. Non-limiting examples of suitable shapes include generally square, rectangular, polygonal, circular, oval, or a combination thereof.

Beverage retainer well 24 provides for upright retention of a beverage container when tray 10 is in an open position. Well 24 is glued, otherwise secured to, or made integral with bottom panel 14 of container 10, and may be manufactured from any suitable material. Non-limiting examples of suitable materials include paper stock, corrugated paper, plastic, styrofoam or a combination thereof Well 24 may be placed in any convenient location on bottom 14 of tray 10. While shown in the figures to include only one well 24, it is understood that any number of wells 24 may be positioned in container 10.

Beverage retainer well 24 defines open area 26 which may be of any suitable size and shape to provide a holder for upright retention of a particular cup or beverage can. Preferably, beverage well 24 is generally cylindrical or slightly conical in shape and of sufficient height h to prevent a beverage container from tilting over, but not prevent closure of lid 28 over food compartment 12. More preferably, beverage well 24 is shaped to allow for the stacking of containers 10 when in the open position.

Figure 2:
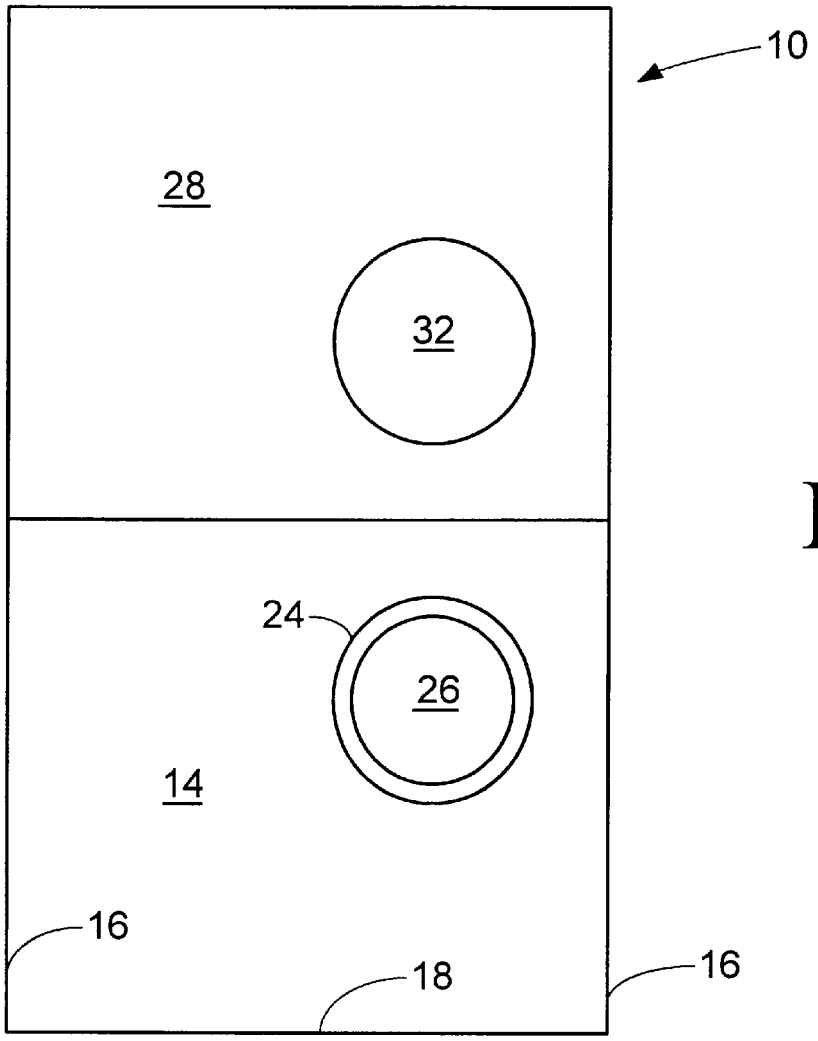
FIG. 2 is a top view of tray 10 in an open position.
Figure 3:
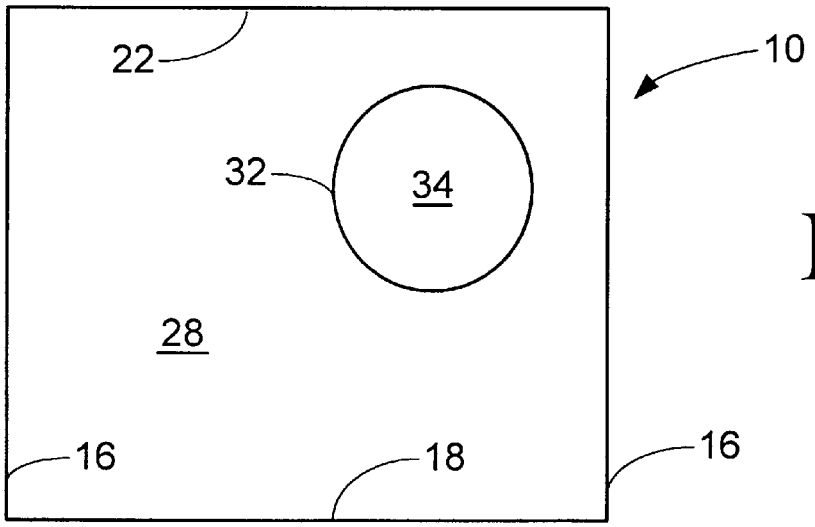
FIG. 3 is a top view of tray 10 in a closed position.

Referring to FIGS. 2 and 3 there is shown a top view of container 10 in an open and closed position respectively. When container 10 is in the open position, a beverage container may be retained upright in well 24. When container 10 is in the closed position, beverage holder 32 is positioned in opening 26 of well 24. Beverage holder 32 being sized to correspond to that of well 24. In the instance where there may be more than one well 24, a corresponding beverage holder 32 in lid 28 will be positioned above each well 24. Beverage container 100 may be placed into beverage holder 32 which sets into opening 26 of well 24 when container 10 is in the closed position allowing for the stable and convenient transportation of the container and beverage.

Beverage retainer well 24 provides for upright retention of a beverage container when tray 10 is in an open position. Well 24 is glued, otherwise secured to, or made integral with bottom panel 14 of container 10, and may be manufactured from any suitable material. Non-limiting examples of suitable materials include paper stock, corrugated paper, plastic, styrofoam or a combination thereof. Well 24 may be placed in any convenient location on bottom 14 of tray 10. While shown in the figures to include only one well 24, it is understood that any number of wells 24 may be positioned in container 10.

Beverage retainer well 24 defines open area 26 which may be of any suitable size and shape to provide a holder for upright retention of a particular cup or beverage can. 130 Preferably, beverage well 24 is generally cylindrical or slightly conical in shape and of sufficient height h to prevent a beverage container from tilting over, but not prevent closure of lid 28 over food compartment 12. More preferably, beverage well 24 is shaped to allow for the stacking of containers 10 when in the open position.

Beverage holder 32 provides for upright retention of a beverage container 100 when tray 10 is in a closed position. Holder 32 is glued, otherwise secured to, or made integral with lid 28 of container 10, and may be manufactured from any suitable material. Non-limiting examples of suitable materials include paper stock, corrugated paper, plastic, styrofoam or a combination thereof. Beverage holder 32 may be placed in any convenient location on lid 28 of tray 10. While shown in the figures to include only one beverage holder 140 32, it is understood that any number of holders 32 may be positioned in container 10.

Referring to FIG. 3, Beverage holder 32 defines open area 34 which may be of any suitable size and shape to provide a holder for upright retention of a particular cup or beverage can. Preferably, holder 32 is generally cylindrical or slightly conical in shape.

More preferably, holder 32 is shaped to allow for the stacking of containers 10 when in the open position.

Referring to FIGS. 2 and 3 there is shown a top view of container 10 in an open and closed position respectively. When container 10 is in the open position, a beverage container 100 may be retained upright in opening 26 of well 24. When container 10 is in the closed position, beverage holder 32 is positioned into opening 26 of well 24. Beverage holder 32 being sized to correspond to that of well 24. In the instance where there may be more than one well 24, a corresponding beverage holder 32 in lid 28 may be positioned above each well 24. Beverage container 100 may be placed into opening 34 of beverage holder 32 which sets into opening 26 of well 24 when container 10 is in the closed position, allowing for the stable and convenient transportation of the container and beverage.

Figure 4A:
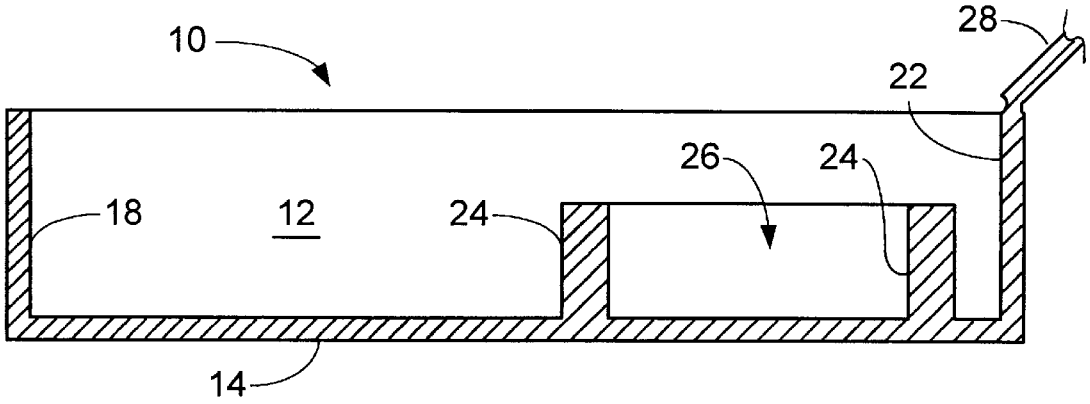
FIGS. 4A and 4B are a side cut away view of tray 10 in an open position without and with drink 100 respectively.
Figure 4B:
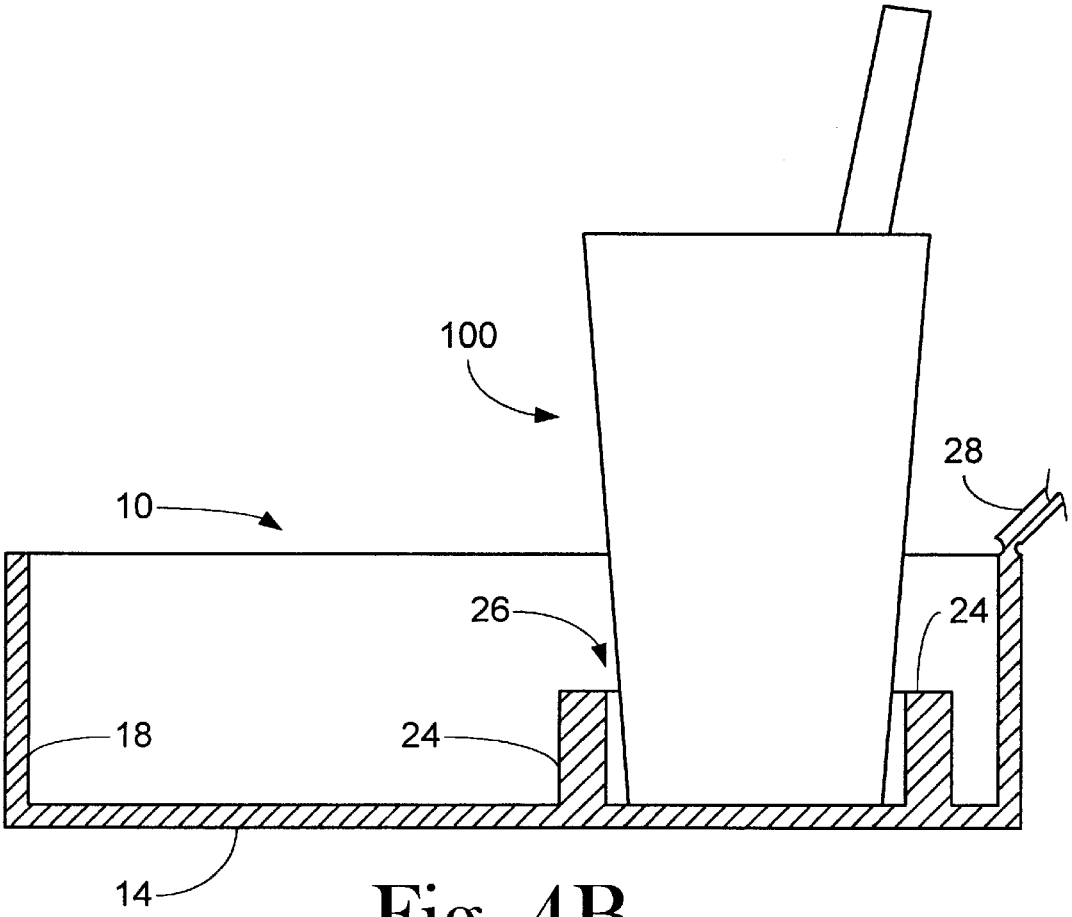
Figure 5A:
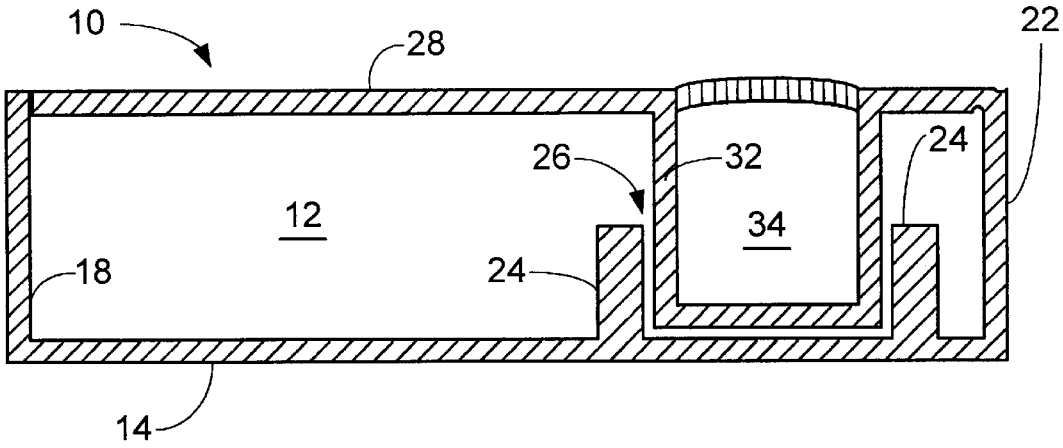
FIGS. 5A and 5B are a side cut away view of tray 10 in a closed position without and with drink 100 respectively.
Figure 5B:
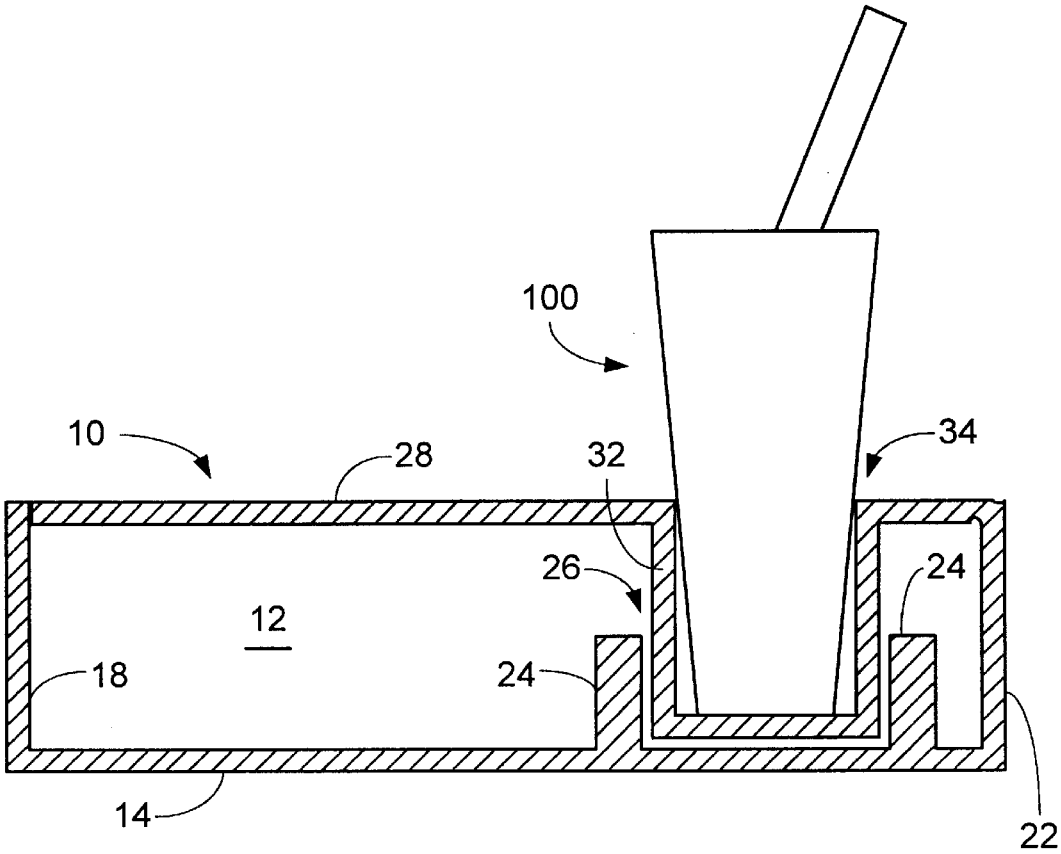

Referring to FIGS. 4A, 4B, 5A, and 5B there is shown a side cut away view of container 10, in open positions and closed positions, without and with beverage container 100 respectively. In using the containers of the present invention, food, for example, may be placed in compartment 12 when lid 28 is opened as in FIG. 4A. After lid 28 is closed, as in FIG. 5A, beverage container 100 may be inserted into opening 34 of beverage holder 32, which nests into opening 26 of well 24, as shown in FIG. 5B, for easy, even one-handed, transportation. Upon arriving at a desired location, beverage container 100 is removed from container 10 and lid 28 is opened. Beverage container 100 may then be placed into well 24, as shown in FIG. 4B for upright retention. Alternately, beverage holder 32 may be lined with flexible tabs, as are known in the art, to aid in the retention of beverage container 100.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which this invention pertains.

I claim:

1. A container comprising:

(a) an interior compartment, including a beverage retention well defining a first opening for holding a beverage container; and (b) a container lid including a beverage holder defining a second opening for holding the beverage container;

wherein the beverage holder is positioned in the first opening when the container lid is in a closed position.

2. The tray of claim 1 wherein the retention well and the beverage holder are generally cylindrical in shape.

3. The container of claim 1 wherein the container is manufactured from a material selected from a group consisting of paper stock, corrugated paper, plastic, styrofoam and a combination thereof.

4. A container comprising:

(a) an interior compartment, including a generally cylindrical beverage retention well defining a first opening for holding a beverage container; and (b) a container lid including a beverage holder defining a second opening for holding the beverage container;

wherein the beverage holder is positioned in the first opening when the container lid is in a closed position, and wherein the container is manufactured from a material selected from a group consisting of paper stock, corrugated paper, plastic, styrofoam and a combination thereof.

5. A method of using a container having an interior and a lid comprising:

positioning a food into the container interior wherein the interior includes a beverage retention well defining an opening for holding a beverage container;

closing the container lid wherein the lid includes a beverage holder defining a second opening for holding the beverage container, wherein the beverage holder is positioned in the first opening when the container lid is in a closed position; and placing a beverage container in the first opening when the container lid is in the closed position.

6. The method of claim 5, wherein the retention well and the beverage holder are generally cylindrical.

7. The method of claim 5, wherein the container is manufactured from a material selected from a group consisting of paper stock, corrugated paper, plastic, styrofoam and a combination thereof.

* * * * *